United States Patent [19]

Zur

[11] 3,934,927

[45] Jan. 27, 1976

[54] POWERED TILTING LOUNGER

[75] Inventor: Henry Chanoch Zur, Tel Aviv, Israel

[73] Assignee: Arizona Lounger Company, Phoenix, Ariz.

[22] Filed: Oct. 29, 1974

[21] Appl. No.: 518,521

[52] U.S. Cl. ..... 297/69; 297/330; 297/348; 297/411

[51] Int. Cl.[2] ..... A47C 1/02

[58] Field of Search ..... 297/284, 69, 88, 68, 411, 297/344, 347, 348, 330, 417, 115, DIG. 10

[56] References Cited

UNITED STATES PATENTS

| | | | |
|---|---|---|---|
| 877,274 | 1/1908 | Weber | 297/417 X |
| 2,647,559 | 8/1953 | Richardson | 297/88 |
| 2,714,922 | 8/1955 | McKibban et al. | 297/330 X |
| 3,016,264 | 1/1962 | Hughes | 297/69 |
| 3,138,402 | 6/1964 | Heyl, Jr. et al. | 297/DIG. 10 |
| 3,381,997 | 5/1968 | Fritz et al. | 297/330 X |
| 3,588,170 | 6/1971 | Knabusch | 297/69 |
| 3,596,990 | 8/1971 | Berger | 297/284 |
| 3,652,126 | 3/1972 | Folling | 297/284 |
| 3,779,600 | 12/1973 | Quackenbush | 297/411 X |

*Primary Examiner*—James T. McCall
*Attorney, Agent, or Firm*—John A. Robertson

[57] ABSTRACT

A powered tilting lounger comprising a pedestal upstanding from a base that rests on a supporting surface and a lounger pivotally mounted on the upper end of the pedestal at the upper forward region of the lounger. The lounger consists of a chair including a seat and a back which are immovable relative to each other and which blend in together with a curved portion whereby it may be occupied by a person in a lounging position. An electric motor is mounted on the pedestal and operates a screw stem to pull the lounging chair structure into an upright position in which an occupant may readily remove himself from the lounger, or pushes it into reclining position.

A leg rest is pivotally mounted on a horizontal axis at the forward edge of the seat portion and is moved into and out of a horizontal leg supporting position by an electric motor. An arm rest is pivotally mounted at its forward end on each side of the lounger and means for securing the arm rests in angularly adjusted positions are provided whereby each arm rest may assume a position for supporting the arms of an occupant, or swung into a horizontal position above the leg rest where it is adapted to support the foot of an occupant. The seat and back of the lounger are covered by a resiliant foam material and mechanism is provided at the lower portion of the back for altering the contour thereof so as to adjust this portion of the back to a particular occupant.

8 Claims, 7 Drawing Figures

POWERED TILTING LOUNGER

The present invention relates to loungers and is concerned primarily with a lounger which is tilted in a particular manner to facilitate the operations of a person seating himself in the lounger or removing himself therefrom.

BACKGROUND OF THE INVENTION

The term lounger as herein used has a meaning which is somewhat more definite than that commonly accepted in the chair and seat art. While the term lounger ordinarily might be considered as describing any chair which is susceptible of being occupied by a person in a lounging position, however, as herein used, the term lounger identifies a chair or comparable seating device which includes a seat and back which are connected by a curved portion which blends in with the seat and back and in which the seat and back are rigid and immovable relative to one another.

The known art includes many examples of chairs for invalids which include seats that may be raised, lowered, and angularly tilted so as to facilitate the seating of a person in the chair or the removal of ther person therefrom. There are also many known devices in which chairs of this general type include backs which are angularly adjustable relative to the seat. Tilting chairs broadly also are known, however, it is believed that there is no known lounger, chair or bed which gives full support to the whole body wherein the body remains resting on a seat, back and arm rests thereby supporting the head, neck and back of the occupant while raised onto his feet or lowered, of the type of which this invention is particularly concerned which is tiltably mounted and motor powered so that it may be readily moved into an upright position in which a person may get into and out of the lounger with a high degree of facility. Also, it is believed that the known art is lacking in a lounger of the type aforesaid which includes a power actuated leg rest which is adapted to be moved from a vertical ineffective position to a horizontal leg supporting position by motor actuated mechanism.

The known art also includes chairs in which the contour of the lower portion of the back may be altered to accommodate the lower back portion of a particular person whereby that person may occupy the chair with a high degree of comfort. Known chairs of this character include two types of mechanisms for achieving this end. One such type is pneumatic and operates on the principle of inflating or deflating a pad or pillow at the lower back of the chair. Another type of mechanism is purely mechanical and operates on the principle of flexing the back portion of the chair by a plurality of screws. Chairs including both types of these mechanisms have not proven effective or convenient to the degree required for public acceptance. It is believed that improved mechanism of this character, when incorporated in a lounger, will enhance its public acceptance.

It is known to provide chairs with arm rests. It is also known to provide invalid chairs with a footrest which supports the foot of an occupant in an upraised position at the side of the chair. One of the features of the present invention is to provide an arm rest at each side of the lounger which is pivotally mounted at its forward end and which may be swung forwardly from an arm supporting position into a foot supporting position. Mechanism is associated with each arm rest for maintaining it in an angularly adjusted position.

OBJECTS OF THE INVENTION

With the foregoing conditions in mind, the present invention has in view providing the following objectives:

1. To provide a lounger within the meaning of this term as herein used, which is pivotally mounted on a horizontal axis at the upper forward region of the chair on supporting structure together with motor actuated mechanism for tilting the chair about this axis into and out of an upright position in which a person may get into and out of the lounger with a high degree of facility.

2. To provide, in a lounger of the type noted, a leg rest which is pivotally mounted on a horizontal axis on the front edge of the seat portion of the chair together with motor actuated mechanism for moving the leg rest into and out of effective position.

3. To provide, in a lounger of the character aforesaid, new and improved means for adjusting the contour of the lower portion of the back whereby the physical features of the back of the occupant may be readily accommodated.

4. To provide, in a lounger of the kind described, an arm rest at each side of the lounger which is pivotally mounted thereon at its forward end and which is adapted to be swung from an arm supporting position to a leg supporting position in front of the seat portion of the lounger, together with mechanism for holding each arm rest in an angularly adjusted position.

Various other more detailed objects and advantages of the invention, such as arise in connection with carrying out the above ideas in a practical embodiment, will, in part, become apparent, and, in part, be hereafter stated as the description of the invention proceeds.

SUMMARY OF THE INVENTION

The foregoing objects are achieved by providing a lounger which includes supporting structure comprising a flat base adapted to rest on the floor or other supporting surface and a pedestal or frame which upstands therefrom. Pivotally mounted on a horizontal axis on the upper end of this pedestal or frame is a body receiving and supporting portion of the lounger which is herein referred to as the lounger proper. The lounger proper comprises a seat portion and back portion joined by a bend or curved portion which is rigid, whereby the seat and back portions are immovable relative to one another. The rigid seat, back and curved portions of the lounger proper are covered by a resilient material of which foam rubber is typical and that portion of this padding is free of or unconnected to the rigid back portion just above the curved portion.

Two embodiments of mechanism for adjusting this portion of padding relative to the rigid back are provided. In one such mechanism, a wedge assembly is employed which is operable from the side of the lounger. In the other embodiment, a rigid bar is interposed between the padding and the rigid backing. The effective position of this bar is adjusted by a pair of cables in flexible casings, the ends of which are conveniently located at the sides of the lounger. Mechanism is provided for applying tension to or relieving tension from the cables to move the bar.

An electric motor is mounted on the supporting structure such as on the frame of a pedestal and this motor operates a screw stem having its upper end pivotally connected to a depending portion on the lounger proper with its other end being threadably received in a socket that is pivotally mounted on the base. This motor may be operated to either exert a pull on the forward depending portion of the lounger proper below the horizontal axis of its pivotal mounting to pull the lounger proper into an upright position in which a person may readily get into or out of the lounger, or exert a thrust on the depending portion of the lounger proper to move the lounger backwardly into a reclining position.

A leg rest is pivotally mounted on a horizontal axis on the front end face of the seat portion. A threaded socket is pivotally connected to the leg rest on the under side thereof adjacent to its pivotal mounting. A screw stem is threadably received in this socket and has its other end operatively connected to an electric motor which is pivotally mounted on the lounger proper below the padding thereon. Thus, the motor may be operated to swing the leg rest into and out of a horizontal leg supporting position in front of the seat portion.

A pair of arm rests are pivotally mounted on the external sides of the forward portions of the lounger proper and are adapted to be swung from arm support position at the sides of the lounger proper and into foot supporting horizontal position in advance of the seat portion of the lounger proper. Mechanism is provided for holding these arm rests in angularly adjusted positions.

For a full and more complete understanding of the invention, reference may be had to the following description and the accompanying drawings wherein.

DESCRIPTION OF THE PREFERRED EMBODIMENT

Figure 1:
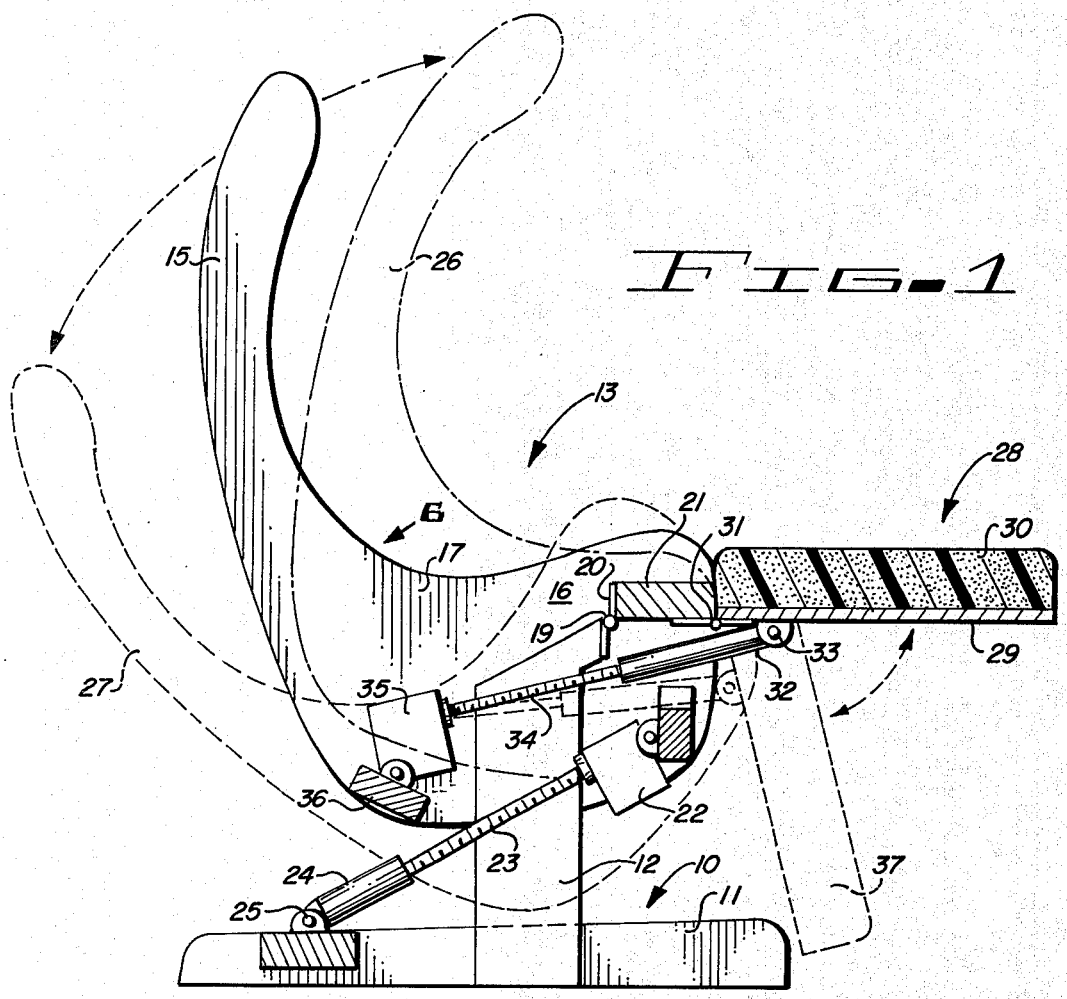
FIG. 1 is a side view partially in section and partially in elevation with portions broken away illustrating the power tilting lounger of this invention with adjusted positions of the lounger proper and leg rest depicted in broken lines.
Figure 3:
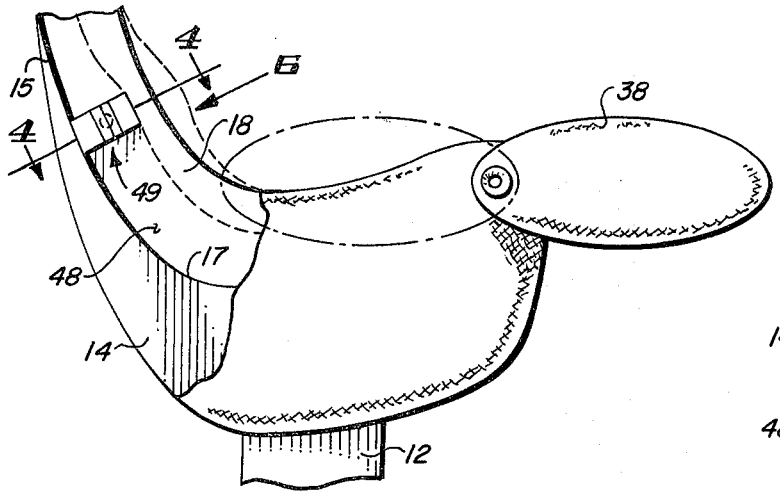
FIG. 3 is another side view partially in section and partially in elevation of the lower portion of the lounger with parts broken away to illustrate the mechanism for adjusting the contour of the padding at the lower portion of the back.

Referring now to the drawings where like reference characters denote like elements through the several views, and first more particularly to FIG. 1, a supporting structure is identified in its entirety by the reference character 10 and is shown as comprising a base 11 and a pedestal or frame 12 which upstands from base 11. A lounger proper or body supporting member is designated generally 13 and comprises a rigid backing 14 (FIG. 3) and a back portion 15, a seat portion 16 and a curved portion 17 which connects back portion 15 to seat portion 16. This rigid backing is covered by a padding 18 of a resilient material of which foam rubber may be taken as an example. FIG. 3 shows the padding 18 as spaced from the rigid backing 14 just above the curved portion 17 and at the lower end of back 15 to accommodate mechanism for adjusting the contour of the padding 18 in this region. Referring now again to FIG. 1, the lounger proper comprising back portion 15, seat portion 16 and curved portion 17 is pivotally mounted at 19 to the upper front edge of pedestal 12. This pivotal mounting may be achieved by using a hinge 20 which has one end secured to a front face of pedestal 12 and its other leaf to a cross bar 21 which is included as a part of the seat portion 16. An electric motor 22 is pivotally mounted on another crossbar which is included in the seat portion 16 with the drive shaft (not illustrated) of motor 22 being operatively connected to a screw stem 23. The lower end of screw stem 23 is threadably received in a tubular socket 24 which is pivotally anchored to base 11 as indicated at 25. It is evident that motor 22 may be operated to rotate screw stem 23 so that the motor exerts pull on crossbar 23 to literally pull the lounger proper 13 into the upright position depicted by the broken line position 26 of FIG. 1, or rotated in the opposite direction to exert a thrust on crossbar 23 to move the lounger proper 13 into a reclining position represented by the broken line position 27.

A leg rest is designated generally 28. It comprises a backing plate 29 which is covered by padding 30 which may be of the same material 18 of the lounger proper. Backing plate 29 is pivotally mounted on the horizontal axis indicated at 31 to the lower front corner of crossbar 21. A tubular threaded socket 32 is pivotally connected at 33 to plate 29 and threadably receives a second screw stem 34. The latter is operatively connected to the drive shaft (not illustrated) of electric motor 35 which is pivotally mounted on a bar 36 which is included in the lounger proper just below curved portion 17. It is evident the electric motor 35 may be operated to swing leg rest 28 from the full line position of FIG. 1 to the broken line position 37 and vice versa.

Figure 2:
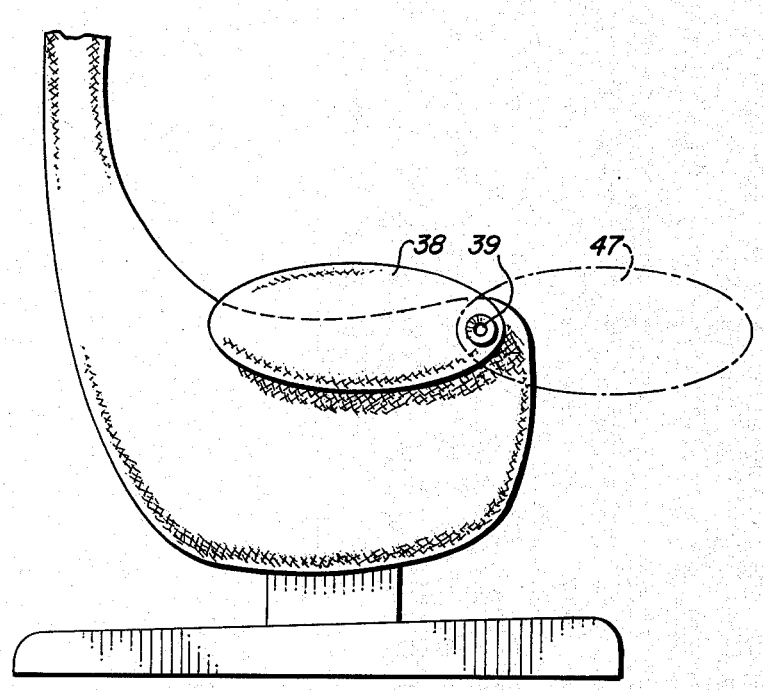
FIG. 2 is a view at side elevation of the lower portion of the lounger illustrating in full lines the position of an arm rest in arm supporting position and in broken lines the position of the arm rests in foot supporting position.
Figure 5:
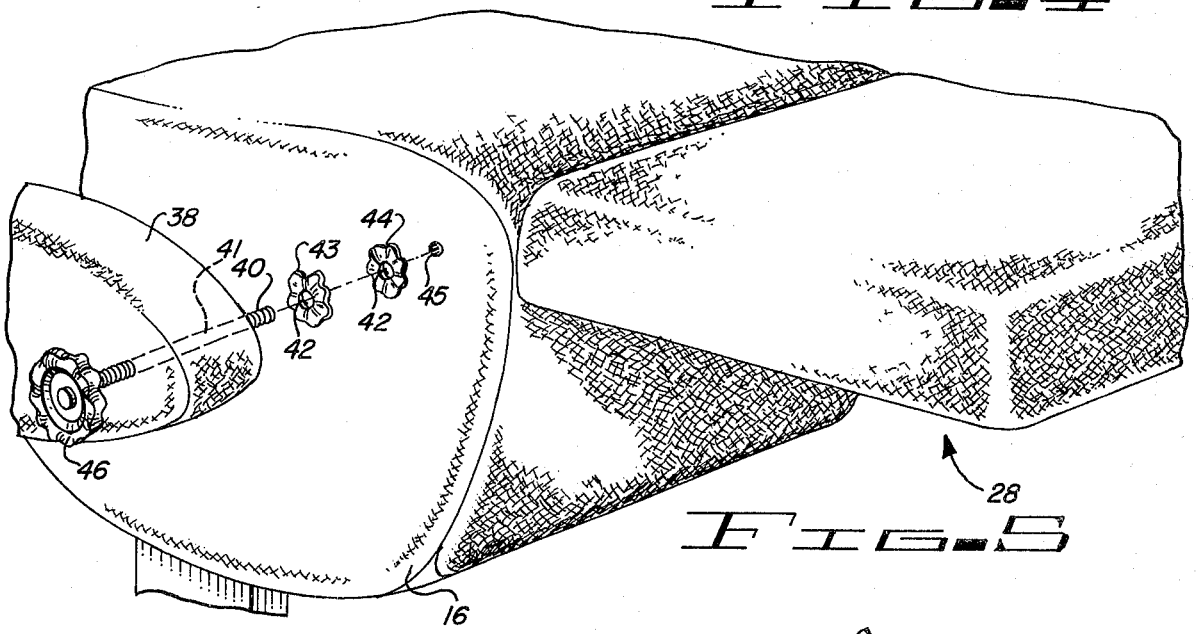
FIG. 5 is a perspective illustrating the forward portion of the seat of the lounger proper with an arm rest and the mechanism for holding it in an angularly adjusted position illustrated in exploded relation.

Referring now to FIGS. 2 and 5, an arm rest is designated 38. It will be understood that there is an arm rest at each side of the lounger and each arm rest is mounted exteriorly of a side of seat portion 16. Each arm rest 38 is pivotally mounted at 39 on a screw shaft 40 which passes through a passage 41 and through central openings 42 in fastening plates 43 and 44 and thence into a threaded socket 45 in seat portion 16. Each of the plates 43 is formed with radial grooves and ribs which interlock when the plates are compressed together. Plate 43 is fixedly secured to the inner surface of arm rest 38 and plate 44 is fixedly secured to the outer face of seat portion 16. Screw stem 40 projects beyond the outer face of arm rest 38 and at its free end carries an operating member in the form of knurled wheel 46 which is manually operable. It is evident that operating member 46 may be availed of to clamp the plates 43 and 44 together and thus secure the arm rest 38 into either the full line position of FIG. 2 or the broken line position 47 of FIG. 2 which is the full line position of FIG. 3. Obviously, the operating member 46 may be rotated to relieve the clamped condition of plates 43 and 44 and thus permit swinging of the arm rest 38 from arm supporting position to foot supporting position.

Figure 4:
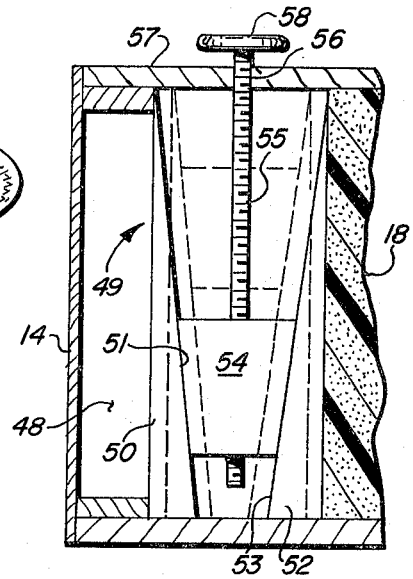
FIG. 4 is a detail mostly in section of the wedge type pad adjusting mechanism being taken on the plane of the line 4 — 4 of FIG. 3.

Referring now more particularly to FIGS. 3 and 4, the space between padding 18 and rigid backing 14 is designated 48. Mounted in this space 48 and extending transversely and across is a wedge mechanism designated generally 49. Mounted in space 18 and forming a part of mechanism 49 is a crossbar 50 that is secured to rigid structure 14 and presents an inclined surface 51. Another crossbar 52 is connected to padding 18 and presents an inclined surface 53. A wedge 54 has inclined surfaces engaging surfaces 51 and 53 and is secured to one end of rod 55, the latter is threaded and passes through a threaded opening 56 and a side wall 57 which is a part of the rigid structure 14 of the back. Rod 55 carries an operating member 58 on its outer free end which may be rotated to move wedge 54 on inclined surfaces 51 and 53 to either enlarge or reduce space 48. Thus, when this space is enlarged, padding 18 is forced outwardly just above curved portion 18 as indicated in FIG. 3 and when reduced, padding 18 will be forced inwardly by the body of the occupant of the lounger.

Figure 6:
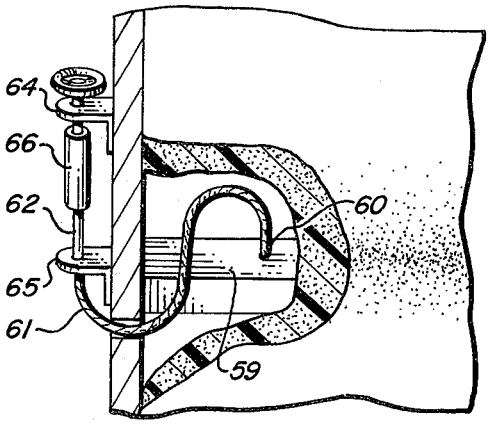
FIG. 6 is a detail of a second embodiment of the means for adjusting the padding, and, FIG. 7 is a detailed section taken normal to the showing of FIG. 6 of the second embodiment for the padding adjusting mechanism.
Figure 7:
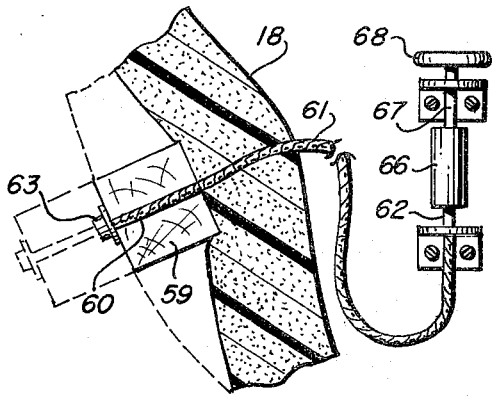

Referring now to FIGS. 6 and 7, another mechanism for altering the contour of the padding above grooved portion of padding 18 will be described. A crossbar 59 extends across space 48 and is secured to the inner face of padding 18 in any preferred manner. At each end of crossbar 59 is a passage 60 with each passage receiving an end portion of a flexible casing 61. A cable 62 passes through casing 61 with the ends of casing 61 with the ends of casing 61 and cable 62 being anchored to crossbar 59 as indicated at 63. A side wall of the rigid portion of the lounger proper which is conveniently located relative to an occupant of the lounger, is shown as having mounted thereon brackets 64 and 65. Flexible casings 61 extend from crossbar 59 where the ends remote from anchorages 63 are fixedly secured to bracket 65. The adjacent end portion of cable 62 passes through openings in bracket 65 and are secured to a screw tensioning device 66. Screw tensioning devices of this type are well known and the details are not herein illustrated and described. It suffices to point out that the end of each cable 62 is secured to one end of a threaded member which is received in a threaded socket carried by a shaft 67 which passes through an opening in bracket 64 and carries an operating member 68 on its outer free end. It is evident that the operating member 68 may be located to exert either a pull or thrust on cable 62 whereby crossbar 59 is moved either away from rigid structure 14 to increase space 48 or towards rigid structure 14 to reduced such space. Thus, the curvature of the padding 18 at the lower end of back 15 may be adjusted.

OPERATION

While the manner of operating and using the above described lounger is believed to be obvious from the illustrations of the drawings and description of the parts set forth above, they may be briefly described as follows:

When a person is desirous of occupying the lounger, motor 35 is activated to move leg rest 28 into the broken line position 37 of FIG. 1 and motor 22 energized to swing the lounger proper 13 into the upright broken line position 26 of FIG. 1. The occupant to be seats himself in the lounger proper 13 whereupon motor 24 is energized to rotate screw stem 23 in the proper direction to swing lounger proper 13 into the reclining broken line position 27 of FIG. 1. If the occupant in this position so desires, leg rest 28 is then swung into the full line position of FIG. 1 by energizing motor 35 to rotate screw stem 34 in the right direction. The position of the arm rest 38 is then determined by the wishes of the occupant. Should he want them to be in arm supporting position, they are moved into the full line position of FIG. 2 and knurled wheels 46 rotated to clamp brackets 43 and 44 into interlocking relation which maintains the arm rest in the desired position. Should he be desirous of moving either one or both of the arm rests 38 into foot supporting position, one or both of the knurled wheels 46 are first loosened, the arm rests 38 swung into the full line position of FIG. 3 and the plates 43 and 44 again clamped into interlocking relation to maintain the position.

The contour or curvature of the padding 18 at the area of 48 may then be adjusted to provide the maximum degree of comfort for the occupant where the lower spinal portion of his body engages the lower portion of the back. With the occupant in the chair, this may be achieved either by rotating the operating member 58 of the wedge mechanism of FIGS. 3 and 4 or operating member 68 of the flexible casing and cable of the embodiment of FIGS. 6 and 7.

When the occupant is desirous of removing his person from the lounger, leg rest 28 is first lowered into the broken line position 37 of FIG. 1 by appropriate operation of motor 35 whereupon the lounger proper is swung into the upright position as indicated by broken lines 26 of FIG. 1 by appropriate operation of the motor 22. The occupant is thus enabled to get out of the chair with a minimum of inconvenience.

While the invention has hereinbefore been described as incorporated into a lounger in which the back and seat are relatively immovable, it is to be understood that the basic concept of the invention may be built into a lounger which also has the ability of functioning as a bed. Thus, certain chairs, of which hospital or invalid chairs may be taken as typical, include a back, the angular position of which, relative to a seat, is adjustable. However, once adjusted and secured in that adjusted position, by well-known mechanisms, for the purposes of this invention they are relatively immovable with respect to each other and hence rigid. In the instant lounger the arm rests are susceptible of being swung into horizontal positions substantially aligning with the leg rest to adapt the lounger for use as a bed.

When the lounger is modified to include such an adjustable back, it is adapted to serve as a bed in which the body of the occupant including his head and neck are supported while the bed is raised to put the occupant on his feet or lowered into a reclining or intermediate position.

While preferred specific embodiments are herein disclosed, it is to be clearly understood that the invention is not to be limited to the exact constructions, mechanisms, and devices illustrated and described because various modifications of these details may be provided in putting the invention into practice.

What is claimed is:

1. In a lounger, a. supporting structure including a base adapted to rest on a floor and a pedestal upstanding from said base;

b. a structural assembly identified as a body supporting member for receiving the body of an occupant and comprising a rigid backing including a back portion, a seat portion, and a bend between and connectiing said back and seat portions, and a resilient pad covering the back and seat portions and the bend of said rigid backing;

c. means for pivotally mounting said body supporting member on said pedestal at the upper end thereof and on a horizontal axis extending through said seat portion in the forward upper region thereof;

d. power means for tilting said body supporting member on said pivotal mounting whereby the body supporting member is moved from a reclining position to an upright position and vice versa;

e. a leg rest pivotally mounted on said seat portion at the forward free end thereof and on a horizontal axis, and, f. an independent power means for swinging said leg rest into and out of a horizontal leg supporting position.

2. The lounger of claim 1 in which the power means for tilting the body supporting member comprises an electric motor pivotally connected to said seat portion, a screw stem operatively connected to and driven by said motor, and a threaded tubular socket receiving said screw stem and pivotally mounted on said supporting structure.

3. The lounger of claim 1 in which the power means for swinging the leg rest comprises a threaded tubular socket pivotally connected to said leg rest, a screw stem received in said socket, and an electric motor pivotally mounted on said rigid backing and operatively connected to said screw stem.

4. The lounger of claim 1 together with a pair of arm rests, each of which is pivotally mounted at what is its forward end when the arm rest is in arm supporting position on the exterior of said seat portion in the forward region thereon, each of said arm rests being swingable into a substantially horizontal position in advance of said seat where it is susceptible of use as a footrest, and means associated with each said pivotal mounting for fixedly securing the arm rest associated thereto in an angularly adjusted position.

5. The lounger of claim 4 in which each of the pivotal mountings for an arm rest and the means associated therewith for securing that arm rest in an angularly adjusted position comprise: a threaded socket in the seat portion opening into the exterior of said seat portion, a first plate fixedly secured to said seat portion on the exterior thereof and having a central opening in alignment with said socket, said plate having grooves and ribs extending radially from said opening therein, a passage extending through the arm rest at the forward end thereof, a second plate corresponding in shape and structure to said first plate whereby it is complemental thereto and having a central opening, said second plate being fixedly secured to said arm rest on the inner face thereof with the opening therein aligning with said passage, and a shaft passing through said passage and plate openings and having a threaded end portion received in said socket; and a manual operating member on said shaft externally of said arm rest, whereby said operating member may be rotated in one direction to separate said plates and thus permit swinging of said arm rest or rotate it in an opposite direction to clamp said plates together and thus secure the arm rest in an angularly adjusted position.

6. The lounger of claim 1 in which the pad is free of and spaced from the rigid backing in the region of the lower part of the back portion and just above said bend, together with means in the space between the free portion of the pad and backing for altering the portion of the free portion of the pad relative to the rigid backing whereby the contour of the lower portion of the pad covering the back portion may be adjusted to accommodate the corresponding back portion of a person occupying the lounger with a high degree of comfort.

7. The lounger of claim 6 in which the means for altering the position of the free portion of the pad takes the form of wedge mechanism including a manual operating member conveniently accessible to an occupant of the lounger.

8. The lounger of claim 6 in which the means for altering the position of the free portion of the pad comprises a crossbar in said space and secured to the inner surface of the pad, a pair of cable and flexible casing assemblies having ends secured to said crossbar, a pair of brackets mounted in spaced relation relative to each other on the external surface at the sides of said seat portion, said cable and casing assemblies extending from said crossbar to said brackets with an end of each being secured to a bracket, and screw mechanism between the brackets of each pair with an end of a cable connected to a first element of the screw mechanism, and a second element complemental to and operatively connected to said first element and having a manual operating member conveniently accessible to an occupant of the lounger.

* * * * *